US008639132B2

(12) United States Patent
Sato et al.

(10) Patent No.: US 8,639,132 B2
(45) Date of Patent: Jan. 28, 2014

(54) DEVELOPER RECOVERY CONTAINER INCLUDING A CONVEYING UNIT INCLUDING A PIPE AND IMAGE FORMING APPARATUS COMPRISING THE DEVELOPER RECOVERY CONTAINER

(75) Inventors: Tomonori Sato, Kanagawa (JP); Masami Tanase, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 8 days.

(21) Appl. No.: 12/850,195

(22) Filed: Aug. 4, 2010

(65) Prior Publication Data

US 2011/0123207 A1 May 26, 2011

(30) Foreign Application Priority Data

Nov. 20, 2009 (JP) ..... 2009-265012

(51) Int. Cl.
*G03G 21/12* (2006.01)

(52) U.S. Cl.
USPC ..... 399/35; 399/360

(58) Field of Classification Search
USPC ..... 399/360, 35, 358, 359
See application file for complete search history.

(56) References Cited

U.S. PATENT DOCUMENTS 6,298,217 B1 * 10/2001 Murayama et al. ..... 399/358
6,937,838 B2 8/2005 Ishii et al.
2004/0052560 A1 * 3/2004 Ishii et al. ..... 399/360
2006/0120779 A1 * 6/2006 Uchihashi ..... 399/358
2007/0196117 A1 * 8/2007 Ishii ..... 399/35
2010/0166461 A1 * 7/2010 Sakurai ..... 399/123

FOREIGN PATENT DOCUMENTS

JP 11143319 A * 5/1999 ..... G03G 21/10
JP 2002-148884 A 5/2002
JP 2006-011360 A 1/2006
JP 2008-309987 A 12/2008

OTHER PUBLICATIONS

Notification of Reason for Refusal dated Sep. 2, 2013, issued by the Japanese Patent Office in application No. 2009-265012.

* cited by examiner

*Primary Examiner* — Billy J Lactaoen
(74) *Attorney, Agent, or Firm* — Sughrue Mion, PLLC

(57) ABSTRACT

A developer recovery container includes a first room that stores a recovered developer; a plurality of linearly obliquely arranged recovery ports facing the first room, a developer removed by a cleaning unit for an intermediate transfer unit and a developer removed by a cleaning unit for a black-image bearing member being dropped in the first room respectively through top one and bottom one of the recovery ports; a second room formed below an area between one of the recovery ports located next to the top recovery port and another recovery port located next to the one recovery port, the developer flowing from the first room to the second room; a conveying unit that conveys the developer in the first room to the second room by a quantity of the developer exceeding a storage limit of the first room; and a sensor that detects the developer in the second room.

8 Claims, 18 Drawing Sheets

DEVELOPER RECOVERY CONTAINER INCLUDING A CONVEYING UNIT INCLUDING A PIPE AND IMAGE FORMING APPARATUS COMPRISING THE DEVELOPER RECOVERY CONTAINER

CROSS-REFERENCE TO RELATED APPLICATIONS

This application is based on and claims priority under 35 USC 119 from Japanese Patent Application No. 2009-265012 filed Nov. 20, 2009.

BACKGROUND (i) Technical Field

The present invention relates to a developer recovery container and an image forming apparatus.

(ii) Related Art

In an image forming apparatus, such as an electrophotographic copier or a laser beam printer, a toner image developed on a photoconductor drum is transferred on a recording sheet, and then a cleaner removes a remaining toner adhering to the photoconductor drum. The removed remaining toner is recovered as a waste toner (a used developer) in a waste-toner recovery box (a developer recovery container) in the image forming apparatus.

In recent years, there is a color image forming apparatus that obtains a color image such that toner images with plural colors formed by plural image forming engines are first transferred from photoconductor drums onto an intermediate transfer belt, and then are second transferred from the intermediate transfer belt onto a recording sheet. In the case of the color image forming apparatus, the photoconductor drums and cleaners that clean the photoconductor drums are provided respectively for, for example, image forming engines of yellow, cyan, magenta, and black. Waste toners have to be recovered from the cleaners of the four image forming engines. After the toner image is second transferred from the intermediate transfer belt onto the recording sheet, a remaining toner adhering to the intermediate transfer belt has to be cleaned. A cleaner is also provided for the intermediate transfer belt. Thus, in the case of the color image forming apparatus, the waste toners from the plural cleaners are recovered in the waste-toner recovery box.

The waste-toner recovery box is an expendable supply. When the waste-toner recovery box is full, the waste-toner recovery box is replaced with an empty waste-toner recovery box.

SUMMARY

According to an aspect of the invention, there is provided a developer recovery container including a first room that stores a recovered developer; a plurality of recovery ports that face the first room and are linearly and obliquely arranged, a developer removed by a cleaning unit for an intermediate transfer unit from the intermediate transfer unit being dropped in the first room through top one of the recovery ports, a developer removed by a cleaning unit for an image bearing member that forms a black image from the image bearing member being dropped in the first room through bottom one of the recovery ports; a second room formed below an area between one of the recovery ports located next to the top recovery port and another recovery port located next to the one recovery port, the developer flowing from the first room to the second room; a conveying unit that conveys the developer in the first room to the second room by a quantity of the developer exceeding a storage limit of the first room; and a sensor that detects the developer in the second room.

BRIEF DESCRIPTION OF THE DRAWINGS

Exemplary embodiment(s) of the present invention will be described in detail based on the following figures, wherein.

DETAILED DESCRIPTION

Figure 1:
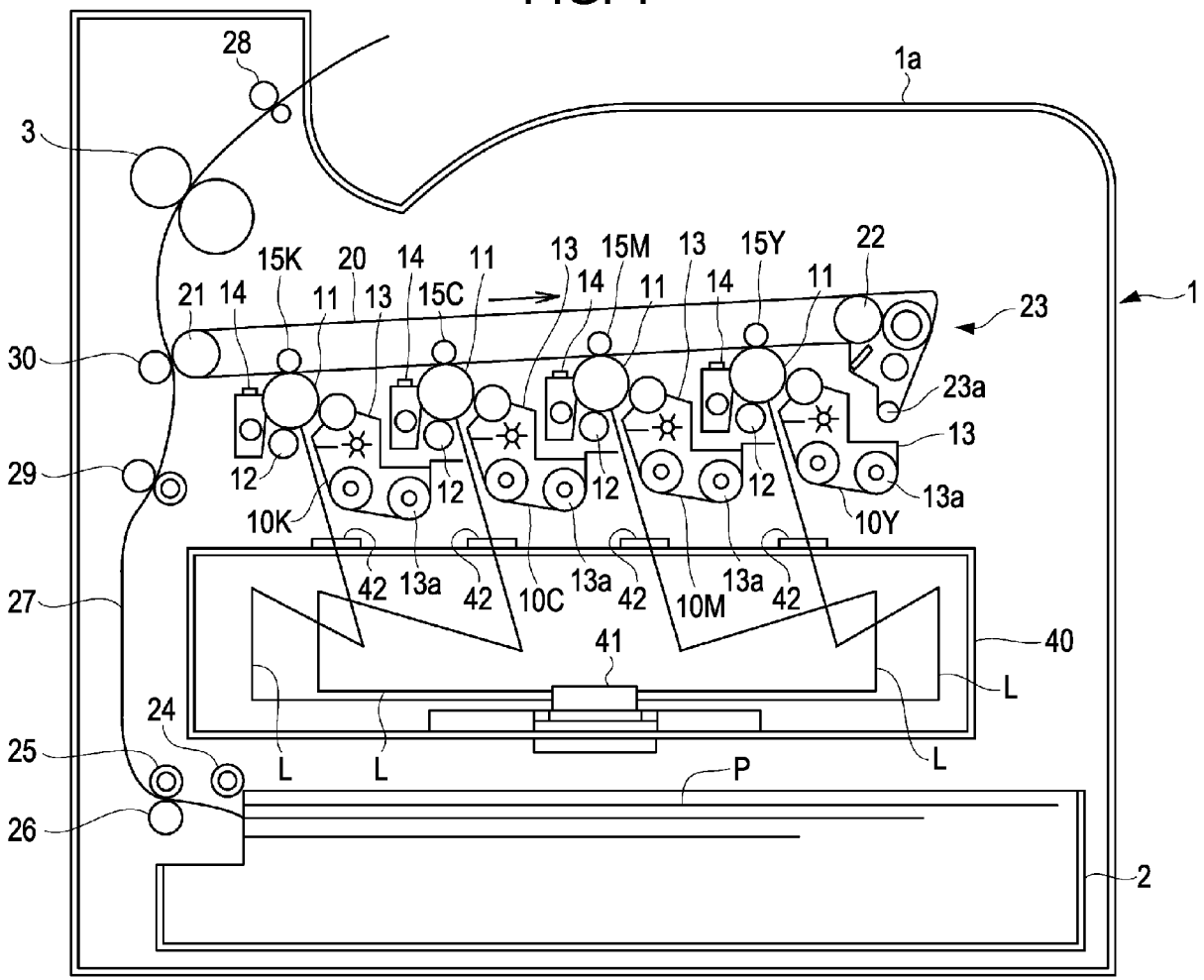
FIG. 1 briefly illustrates a configuration of a printer having a waste-toner recovery box according to an exemplary embodiment of the invention attached to the printer.

An exemplary embodiment as an example of the present invention will be described in detail below with reference to the attached drawings. In the drawings for describing the exemplary embodiment, the same reference signs are basically applied to equivalent components, and the redundant description is omitted.

Referring to FIG. 1, a tandem-type color laser beam printer 1 (an example of an image forming apparatus) having a waste-toner recovery box attached to the printer 1 includes four image forming engines 10Y, 10M, 10C, and 10K that form toner images of colors including yellow (Y), magenta (M), cyan (C), and black (K). The printer 1 also includes an intermediate transfer belt 20. The toner images from the image forming engines 10Y, 10M, 10C, and 10K are transferred on the intermediate transfer belt 20 in a superposed manner (first transfer). The toner images transferred on the intermediate transfer belt 20 in a superposed manner are transferred on a recording sheet P (second transfer), and hence a full-color image is formed.

The intermediate transfer belt 20 is an endless belt and wound around a pair of belt conveying rollers 21 and 22. The intermediate transfer belt 20 receives the first transfer of the toner images formed by the image forming engines 10Y, 10M, 10C, and 10K of the respective colors while the intermediate transfer belt 20 is rotated in a direction indicated by an arrow in FIG. 1.

A second transfer roller 30 is provided at a position to face the one belt conveying roller 21 with the intermediate transfer belt 20 arranged therebetween. The recording sheet P passes through a portion between the second transfer roller 30 and the intermediate transfer belt 20 that mutually contact one another with a pressure, and receives the secondary transfer of the toner images from the intermediate transfer belt 20. A belt cleaner 23 (an example of a cleaning unit) for the intermediate transfer belt 20 (as an example of an intermediate transfer unit) is arranged at a position to face the other belt conveying roller 22. The belt cleaner 23 removes the toner remaining on and adhering to the intermediate transfer belt 20 after the second transfer, from the intermediate transfer belt 20. The remaining toner removed by the belt cleaner 23 is conveyed as a waste toner to the front (a near side in FIG. 1) by a conveying shaft 23*a* that includes a spiral blade, and is recovered in a waste-toner recovery box (described later).

The four image forming engines 10Y, 10M, 10C, and 10K are linearly and obliquely arranged below the intermediate transfer belt 20 (see FIGS. 4 to 8). The image forming engines 10Y, 10M, 10C, and 10K first transfer the toner images that are formed in accordance with image information of the respective colors onto the intermediate transfer belt 20. The four image forming engines 10Y, 10M, 10C, and 10K are arranged in order of yellow, magenta, cyan, and black in a rotation direction of the intermediate transfer belt 20. The black-image forming engine 10K that is generally the most frequently used is arranged nearest the second transfer position.

A raster scanning unit 40 is provided below the image forming engines 10Y, 10M, 10C, and 10K. The raster scanning unit 40 exposes photoconductor drums 11 (an example of image bearing members) of the respective image forming engines 10Y, 10M, 10C, and 10K with light in accordance with image information. The raster scanning unit 40 is common to all the image forming engines 10Y, 10M, 10C, and 10K, and includes four semiconductor lasers (not shown) that emit laser beams L that are modulated in accordance with the image information of the respective colors, and a polygonal mirror 41 that rotates at a high speed and causes the laser beams L to axially scan the photoconductor drums 11. The laser beams L from the polygonal mirror 41 are reflected by mirrors (not shown) and propagate in predetermined paths. The photoconductor drums 11 of the image forming engines 10Y, 10M, 10C, and 10K are exposed with the laser beams L through scanning windows 42 provided in an upper portion of the raster scanning unit 40.

Each of the image forming engines 10Y, 10M, 10C, and 10K includes the photoconductor drum 11, a charging roller 12 that electrically charges the surface of the photoconductor drum 11 to have a predetermined potential, a developing unit 13 that develops an electrostatic latent image formed on the photoconductor drum 11 by the exposure with the laser beam L and forms a toner image, and a drum cleaner 14 (an example of a cleaning unit) that removes a remaining toner and paper dust from the surface of the photoconductor drum 11 after the toner image is transferred on the intermediate transfer belt 20. The toner images in accordance with the image information of the respective colors are formed on the photoconductor drums 11.

In the printer 1 according to this exemplary embodiment, the developing unit 13 uses a two-component developer containing a toner and a carrier. To omit maintenance work for exchanging the developer deteriorated with time, a trickle development system is used in which the developer containing the toner and the carrier is supplied from a supply cartridge (not shown), and the deteriorated developer is automatically exhausted.

Each developing unit 13 is supplied with a new developer from the rear (a far side in FIG. 1) of a conveying shaft 13*a* including a spiral blade like the conveying shaft 23*a*. A remaining toner removed by each drum cleaner 14 is exhausted as a waste toner to the front by a conveying shaft (not shown). The waste toner exhausted from the drum cleaner 14 is recovered in a waste-toner recovery box 50 (described later).

Exemplary developers to be recovered according to this exemplary embodiment are waste toners including used toners exhausted from the drum cleaners 14 and a used toner exhausted from the belt cleaner 23. For example, a recovery box that recovers the carrier and the toner exhausted from the developing unit 13, or a recovery box that recovers only the used toners exhausted from the drum cleaners 14 may be used.

First transfer rollers 15Y, 15M, 15C, and 15K are provided at positions to face the photoconductor drums 11 of the image forming engines 10Y, 10M, 10C, and 10K with the intermediate transfer belt 20 arranged therebetween. When transfer bias voltages are applied to the transfer rollers 15Y, 15M, 15C, and 15K, electric fields are formed between the photoconductor drums 11 and the transfer rollers 15Y, 15M, 15C, and 15K. The toner images on the photoconductor drums 11 with electric charges are transferred on the intermediate transfer belt 20 by Coulomb forces.

Meanwhile, the recording sheet P is transported from a sheet feed cassette 2 accommodated in a lower portion of the printer 1, to the inside of a housing, and more particularly to the second transfer position at which the intermediate transfer belt 20 contacts the second transfer roller 30. To set the sheet feed cassette 2, the sheet feed cassette 2 is pushed into the printer 1 from the front of the printer 1. A pickup roller 24 and a sheet feed roller 25 are provided above the set sheet feed cassette 2. The pickup roller 24 picks up the recording sheet P in the sheet feed cassette 2. Also, a retard roller 26 is provided at a position to face the sheet feed roller 25. The retard roller 26 prevents double feeding of recording sheets P.

A transport path 27 for the recording sheet P in the printer 1 is provided in a vertical direction along a left side surface of the printer 1. The recording sheet P picked from the sheet feed cassette 2 located at the bottom of the printer 1 is elevated in the transport path 27. A registration roller 29 controls an entry timing of the recording sheet P and introduces the recording sheet P to the second transfer position. The toner images are transferred on the recording sheet P at the second transfer position. Then, the recording sheet P is sent to a fixing unit 3 provided in an upper portion of the printer 1. The fixing unit 3 fixes the toner images to the recording sheet P. An output roller 28 outputs the recording sheet P with the fixed toner images, on a sheet output tray la provided on an upper surface of the printer 1, in a state in which an image formed surface of the recording sheet P faces the lower side.

When a full-color image is formed by the color laser beam printer 1 with such a configuration, the raster scanning unit 40 exposes the photoconductor drums 11 of the image forming engines 10Y, 10M, 10C, and 10K with light in accordance with the image information of the respective colors at a predetermined timing. Accordingly, electrostatic latent images are formed on the photoconductor drums 11 of the image forming engines 10Y, 10M, 10C, and 10K in accordance with the image information. By supplying the electrostatic latent images with the toners, the toner images are formed.

The toner images formed on the photoconductor drums 11 of the image forming engines 10Y, 10M, 10C, and 10K are successively transferred on the rotating intermediate transfer belt 20. Thus, the multiple toner images, in which the toner images of the respective colors are superposed on one another, are formed on the intermediate transfer belt 20. Meanwhile, the recording sheet P is sent from the sheet feed cassette 2 and passes through the portion between the second transfer roller 30 and the intermediate transfer belt 20 at a proper timing at which the toner images which have been first transferred on the intermediate transfer belt 20 reach the second transfer position. Accordingly, the multiple toner images on the intermediate transfer belt 20 are second transferred on the recording sheet P. The fixing unit 3 fixes the second transferred toner images to the recording sheet P. Thus, the image formation of a full-color image on the recording sheet P is completed.

In the printer 1 according to this exemplary embodiment having such a configuration, all the waste toners exhausted from the belt cleaner 23 and the respective drum cleaners 14 are recovered in a single waste-toner recovery box 50 (an example of a developer recovery container).

Figure 2:
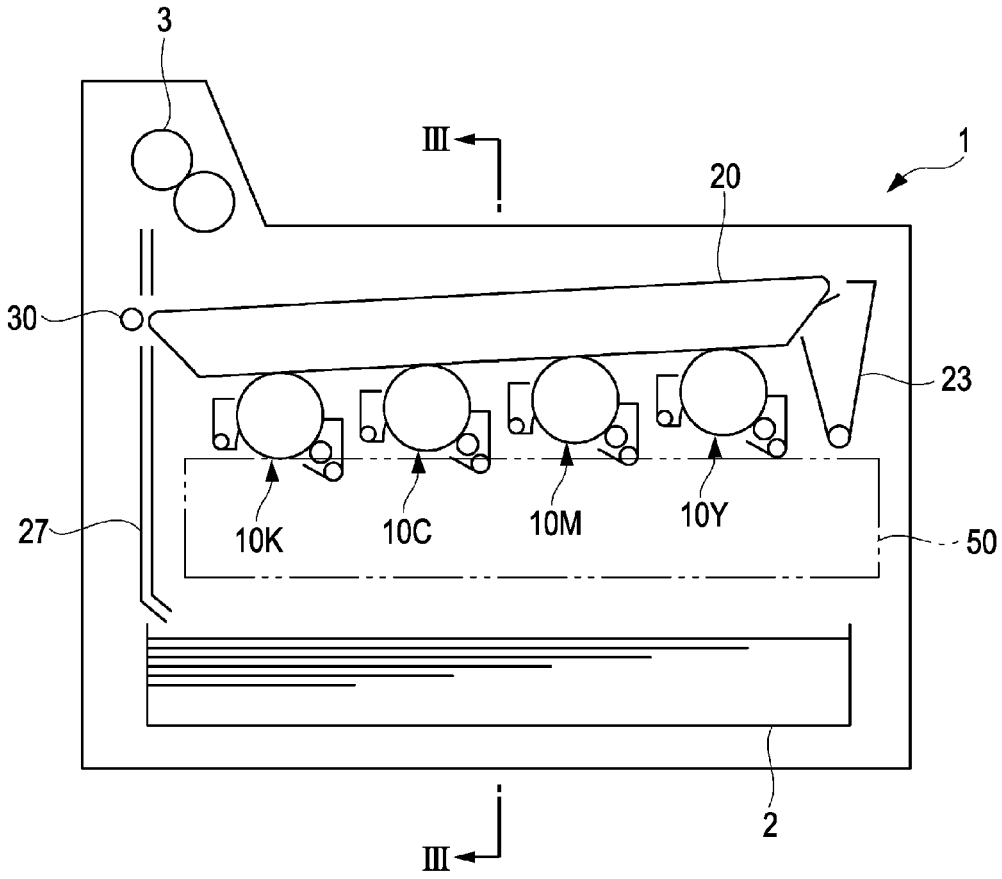
FIG. 2 briefly illustrates an arranged position of the waste-toner recovery box in the printer shown in FIG. 1.
Figure 3:
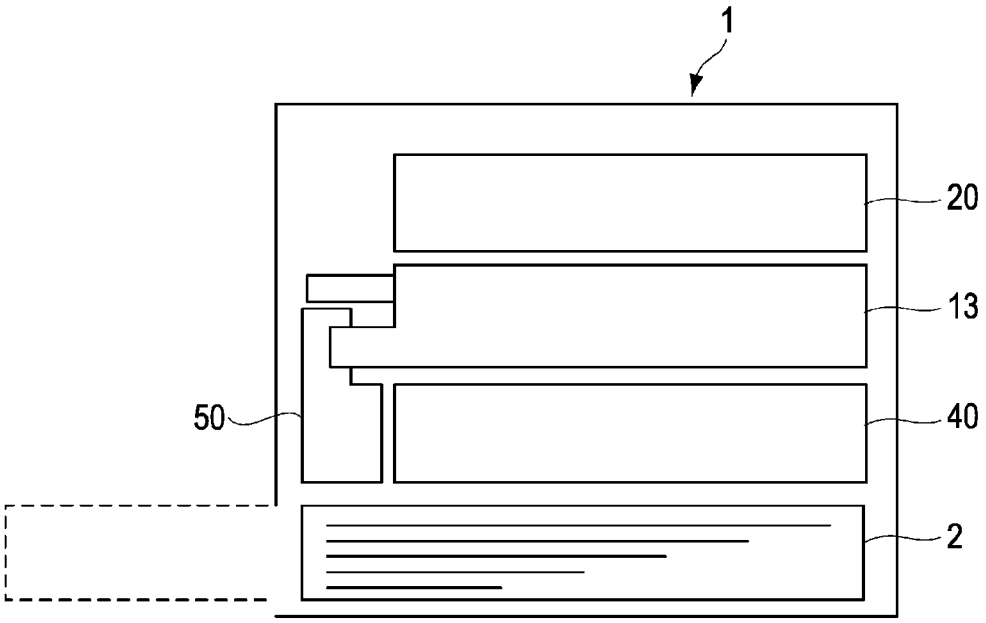
FIG. 3 is a cross-sectional view taken along line III-III in FIG. 2.
Figure 4:
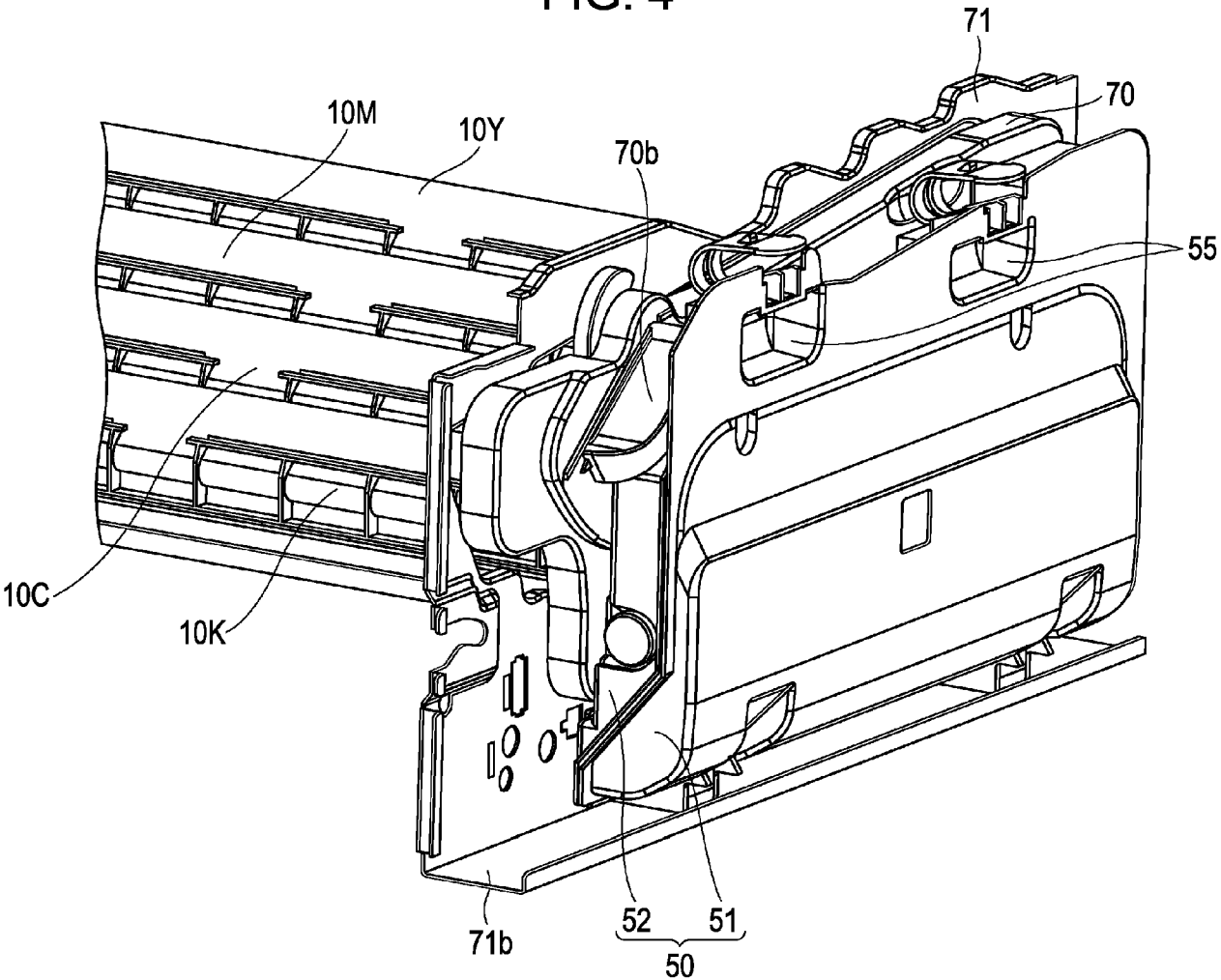
FIG. 4 is a perspective view showing a positioning plate and image forming engines when the waste-toner recovery box is attached to the printer shown in FIG. 1.

Referring to FIGS. 2 and 3, the waste-toner recovery box 50 is provided at the front of the linearly and obliquely arranged image forming engines 10Y, 10M, 10C, and 10K of yellow, magenta, cyan, and black. The waste-toner recovery box 50 is provided at a position slightly below the image forming engines 10Y, 10M, 10C, and 10K. The waste toners exhausted from the drum cleaners 14 to the front are recovered in the waste-toner recovery box 50. The waste toner removed from the intermediate transfer belt 20 by the belt cleaner 23 is also recovered in the waste-toner recovery box 50.

Now, a specific positional relationship between the waste-toner recovery box 50 and the image forming engines 10Y, 10M, 10C, and 10K will be described with reference to FIGS. 4 to 8.

Referring to FIGS. 4 to 8, the waste-toner recovery box 50 is arranged at the most front side in the printer 1 (that is, directly behind a front panel (not shown)). A positioning plate 70 is arranged behind the waste-toner recovery box 50. An inner wall 71 is arranged behind the positioning plate 70. The image forming engines 10Y, 10M, 10C, and 10K are arranged behind the inner wall 71.

Figure 5:
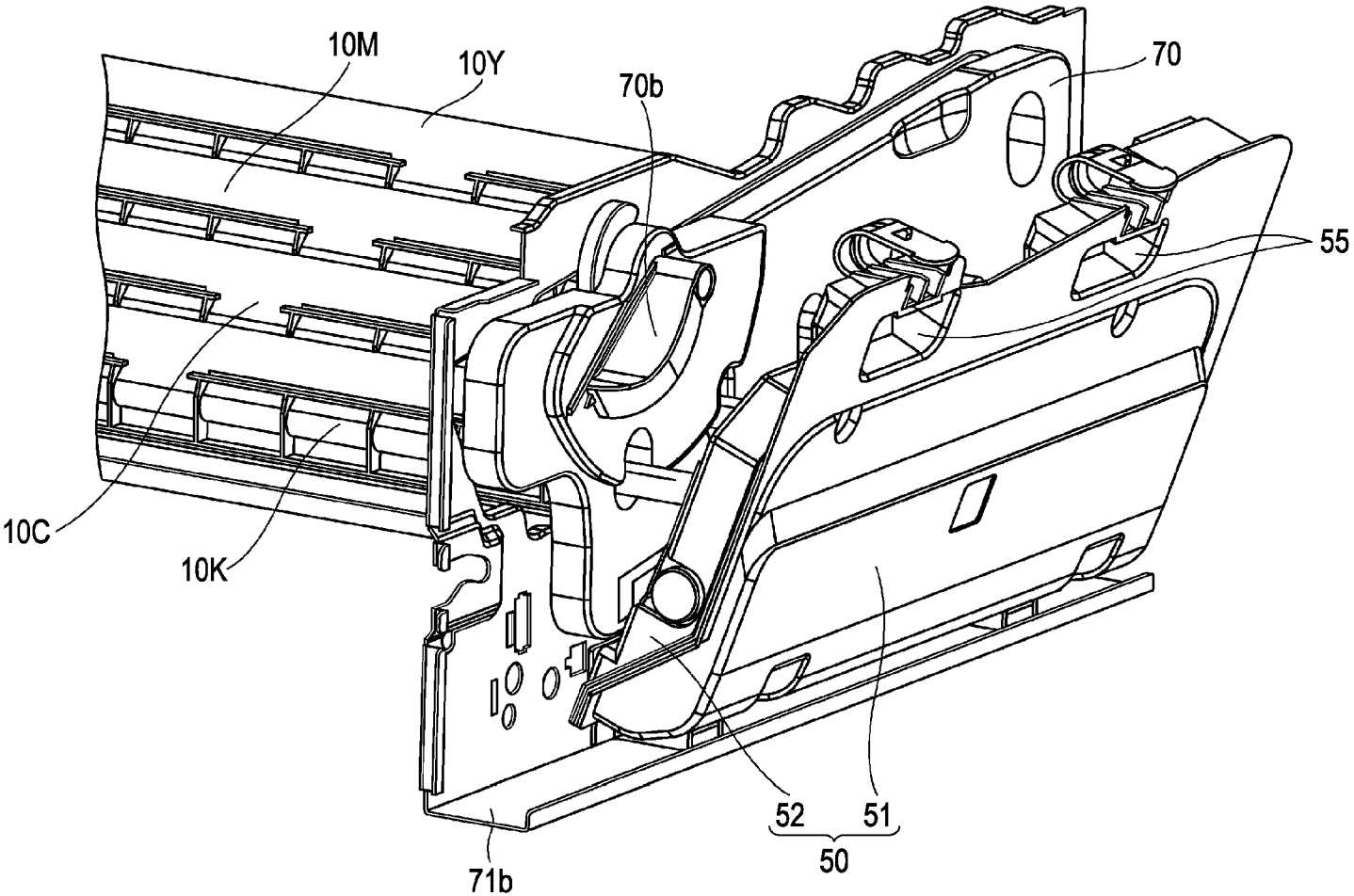
FIG. 5 is a perspective view showing the positioning plate and the image forming engines when the waste-toner recovery box is tilted forward, in the printer shown in FIG. 1.

A lower portion of the waste-toner recovery box 50 is supported by a base piece 71*b* that is bent to extend form a lower end of the inner wall 71 to the front. The waste-toner recovery box 50 stands straight when the waste-toner recovery box 50 is attached to the printer 1 (FIG. 4), and is tilted forward by a certain angle around the lower portion that serves as a support point when the waste-toner recovery box 50 is attached or detached (FIG. 5).

Figure 6:
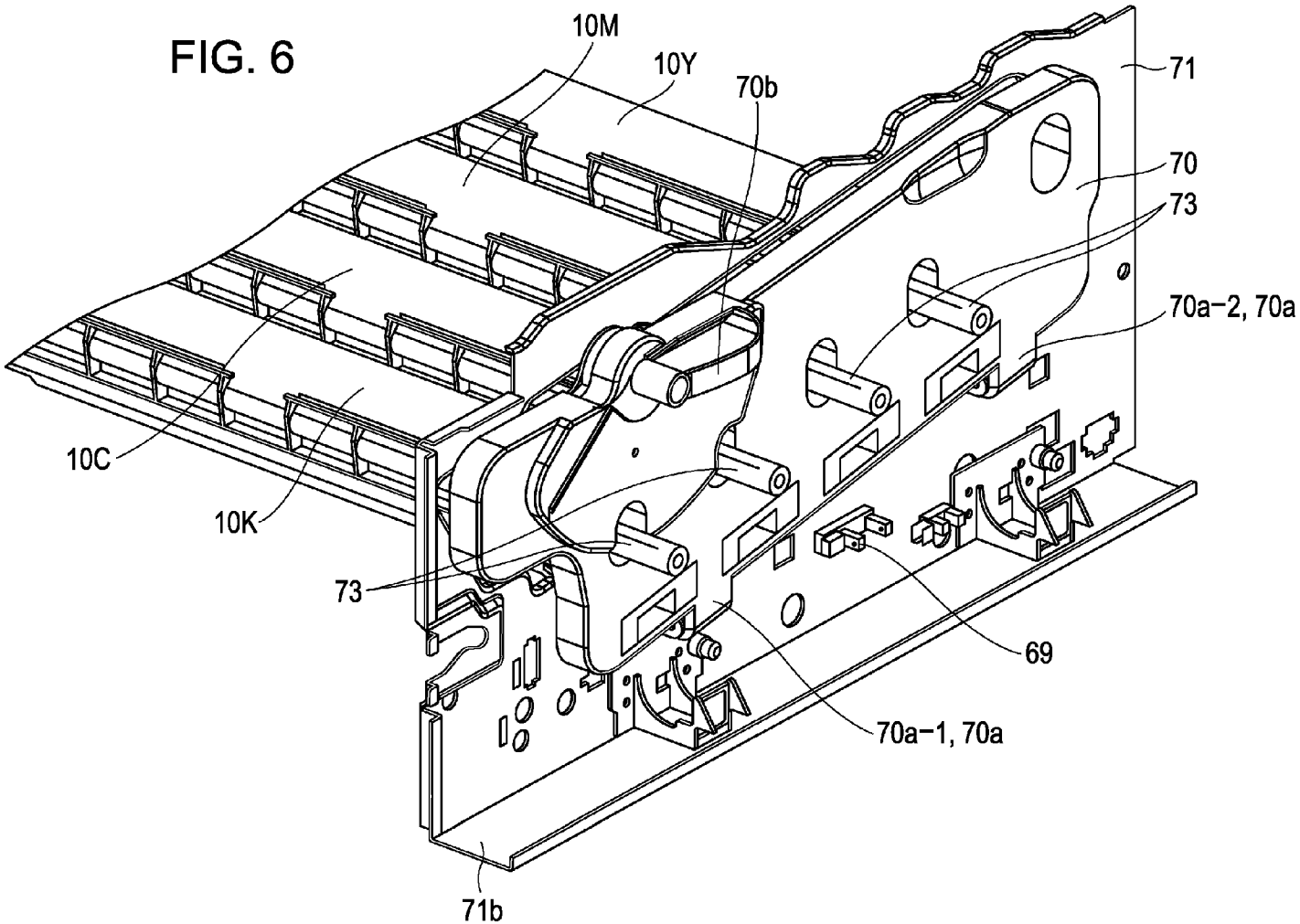
FIG. 6 is a perspective view showing the positioning plate and the image forming engines when the waste-toner recovery box is detached from the printer shown in FIG. 1.
Figure 7:
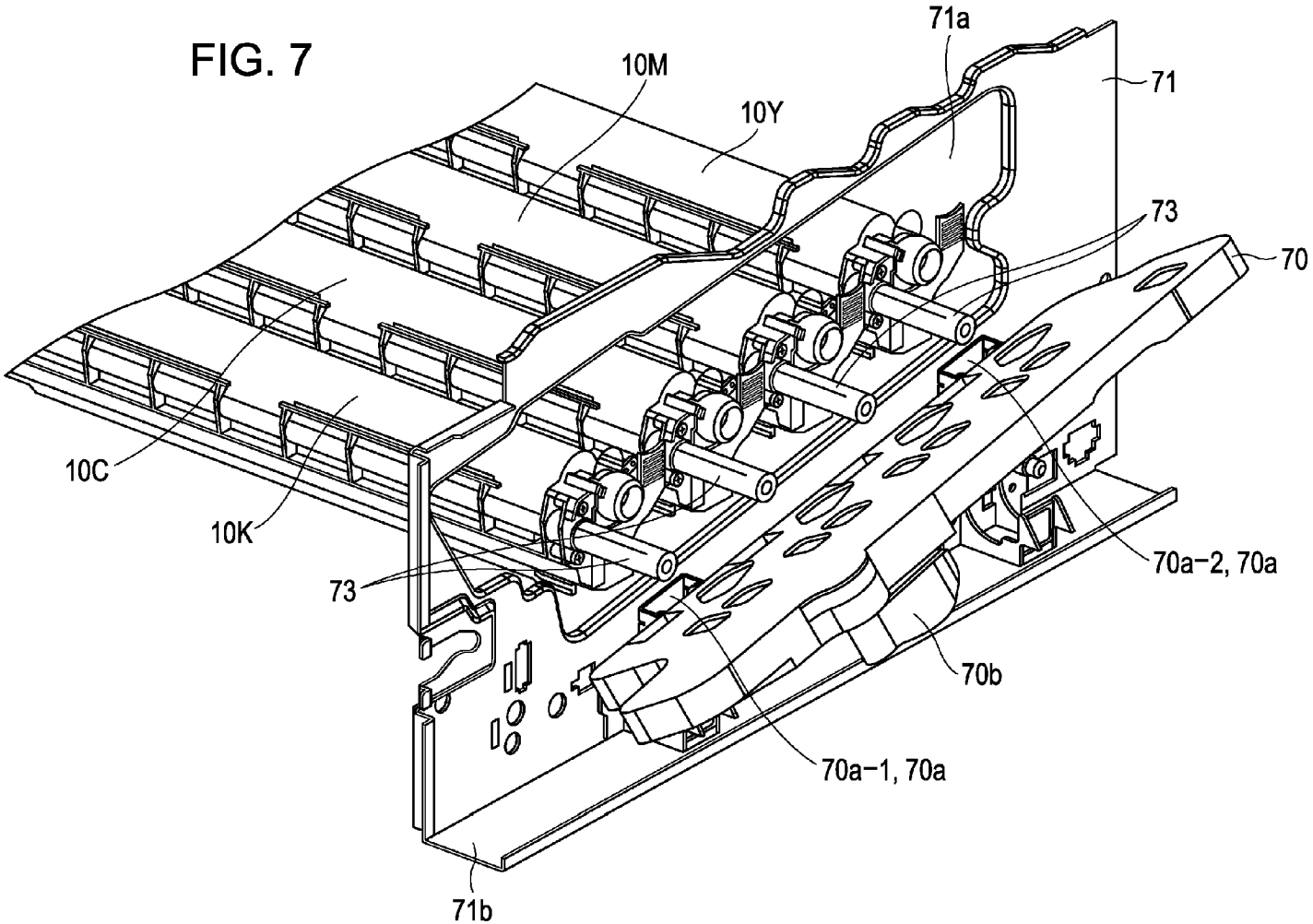
FIG. 7 is a perspective view showing the positioning plate and the image forming engines when the positioning plate is tilted forward, in the printer shown in FIG. 1.
Figure 8:
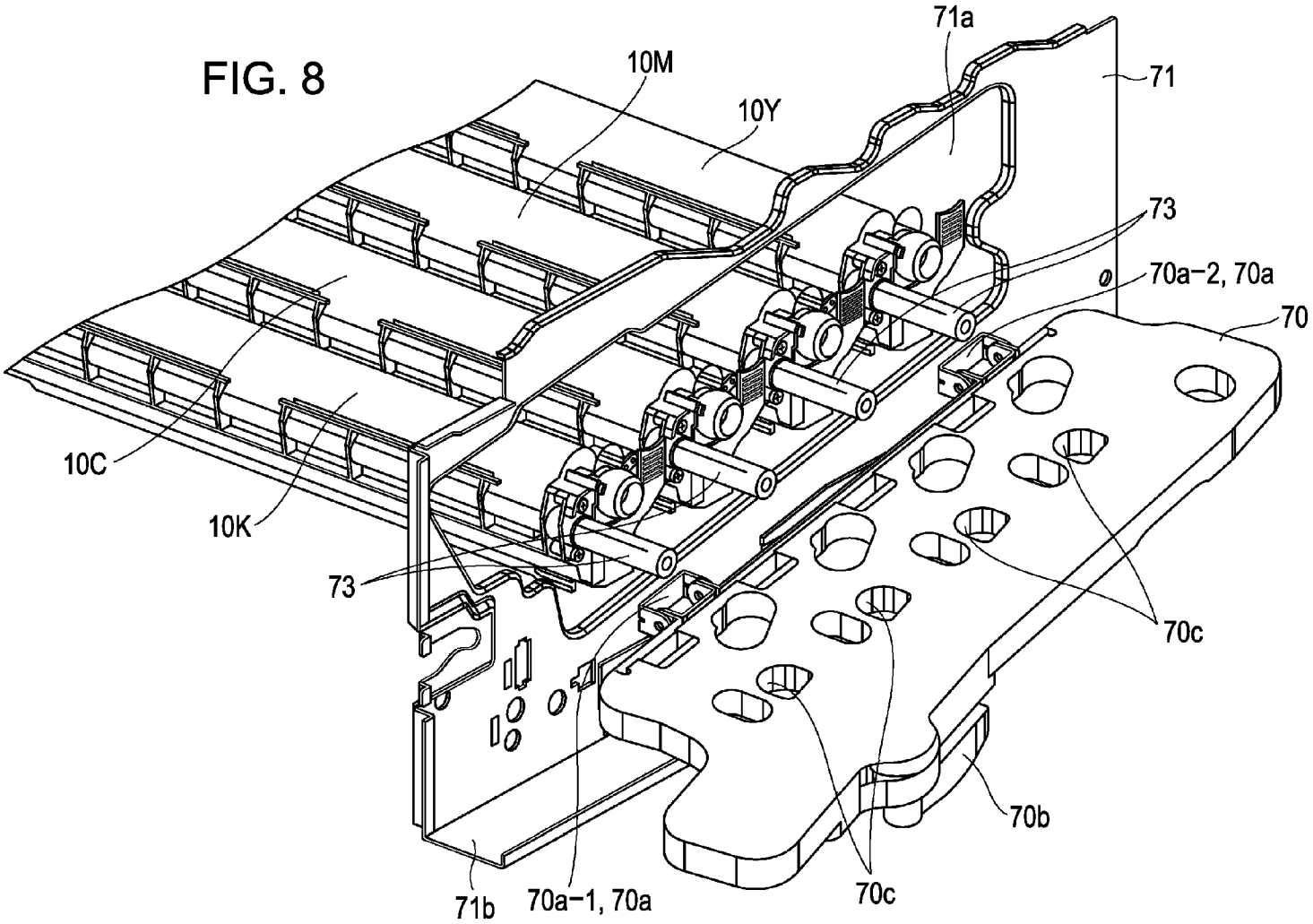
FIG. 8 is a perspective view showing the positioning plate and the image forming engines when the positioning plate is further tilted forward, in the printer shown in FIG. 1.

As described above, the positioning plate 70 is arranged on a rear surface of the waste-toner recovery box 50. The positioning plate 70 positions the photoconductor drums 11 of the image forming engines 10Y, 10M, 10C, and 10K. Referring to FIGS. 6 to 8, the positioning plate 70 has two rotating shafts 70*a* at the lower portion, and is attached to the inner wall 71 via the two rotating shafts 70*a*. To replace the image forming engines 10Y, 10M, 10C, and 10K, the positioning plate 70 is rotated around the rotating shafts 70*a* as support points to be further tilted forward and become substantially horizontal. The positioning plate 70 stands straight when the positioning plate 70 positions the photoconductor drums 11 (FIG. 6). The positioning plate 70 includes a positioning lever 70*b*, and has positioning grooves 70*c* each having a substantially V-like shape. By operating the positioning lever 70*b*, support shafts (not shown) of the photoconductor drums 11 are displaced downward, and pushed into the positioning grooves 70*c*. The photoconductor drums 11 are positioned at predetermined positions. The inner wall 71 has an opening 71*a* for the convenience of attachment and detachment of the image forming engines 10Y, 10M, 10C, and 10K in the longitudinal direction.

The two rotating shafts 70*a* are obliquely arranged along the image forming engines 10Y, 10M, 10C, and 10K. Thus, the rotating shafts 70*a* are rotated such that the positioning plate 70 is tilted obliquely forward (see FIGS. 7 and 8). When the positioning plate 70 is tilted forward, the four image forming engines 10Y, 10M, 10C, and 10K that are linearly and obliquely arranged are exposed through the opening 71*a* of the inner wall 71.

Referring to FIGS. 9 to 12, the waste-toner recovery box 50 includes a front cover 51 and a rear cover 52 made of plastic. The front and rear covers 51 and 52 are combined and hence define a housing. The housing has spaces therein (for example, a reservoir chamber 61 and a detection chamber 67, described later). The waste-toner recovery box 50 is long in the width direction. The thickness of the waste-toner recovery box 50 is smaller than the length thereof in the vertical direction. The length in the width direction of the waste-toner recovery box 50 is longer than a length from the drum cleaner 14 for the black-image forming engine 10K to the belt cleaner 23. When the waste-toner recovery box 50 is attached to the printer 1, the waste-toner recovery box 50 is located at the front of the image forming engines 10Y, 10M, 10C, and 10K and the belt cleaner 23. Thus, the waste toner is directly dropped into the inner space (the reservoir chamber 61).

Figure 9:
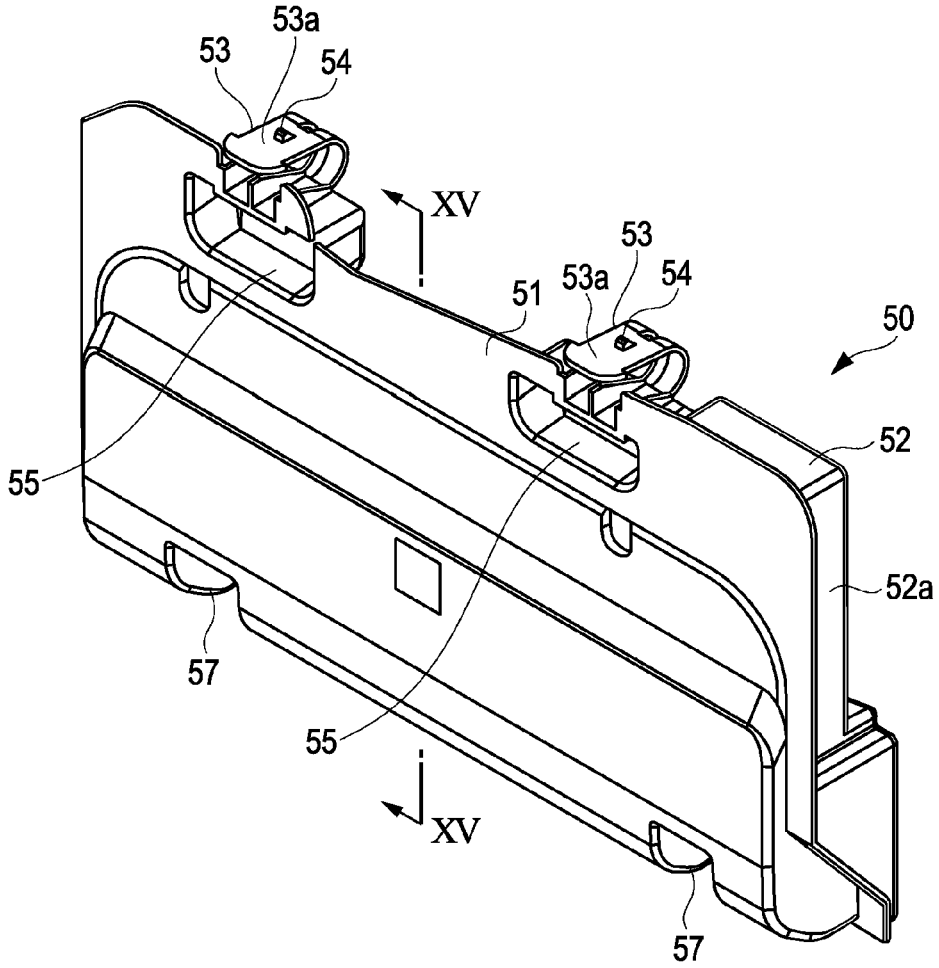
FIG. 9 is a perspective view showing the waste-toner recovery box according to the exemplary embodiment of the invention when viewed from a front surface.
Figure 10:
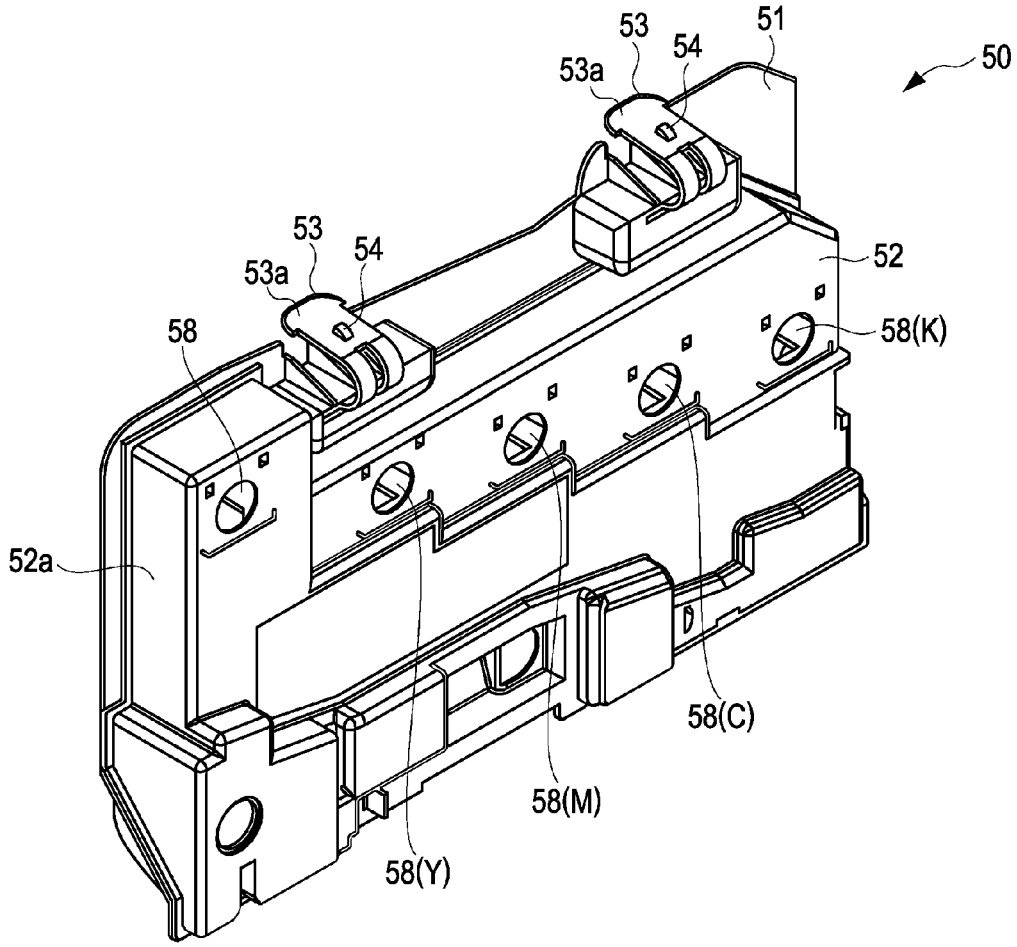
FIG. 10 is a perspective view showing the waste-toner recovery box according to the exemplary embodiment of the invention when viewed from a rear surface.
Figure 11:
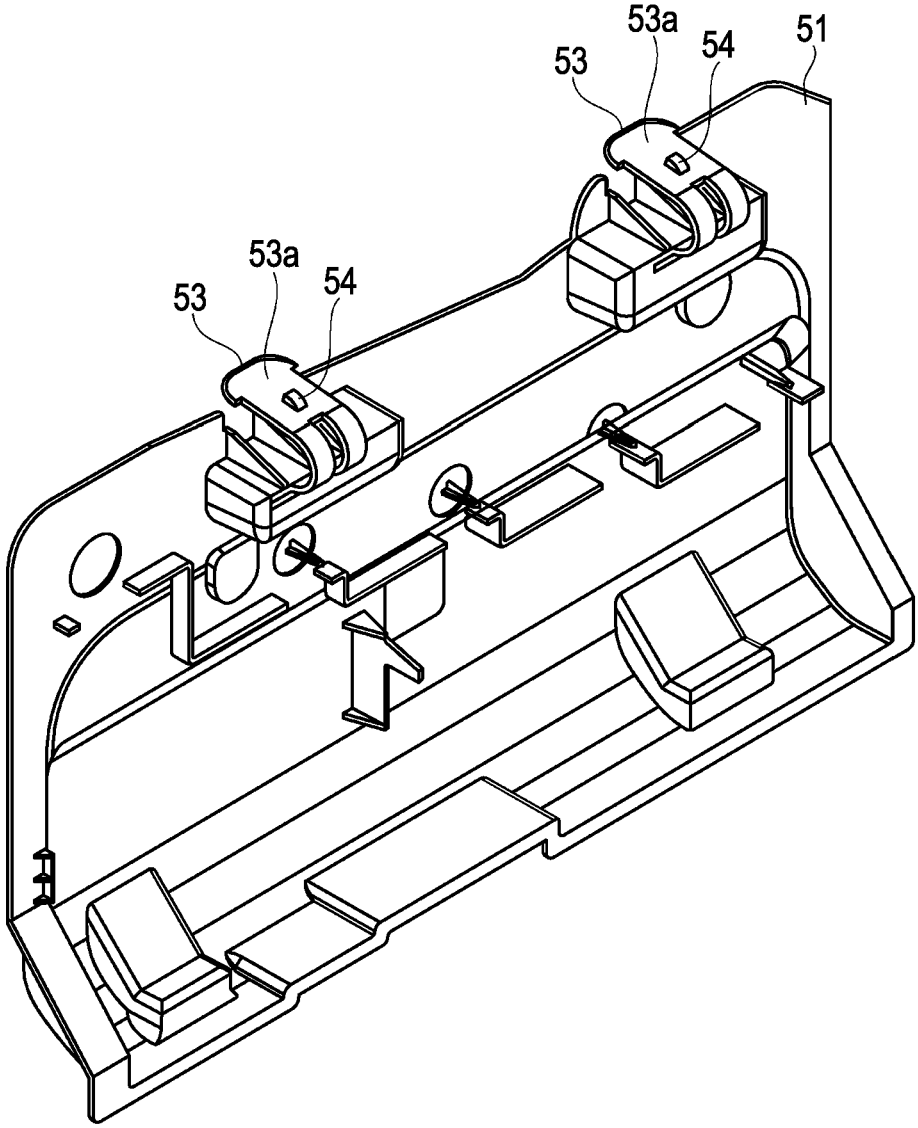
FIG. 11 is a perspective view showing the inside of a front cover that is a component of the waste-toner recovery box according to the exemplary embodiment of the invention.

Referring to FIGS. 9, 10, and 11, lock pieces 53 are provided at two positions of an upper portion of the front cover 51. Each lock piece 53 has a free end facing the front, and has an upper surface 53*a* and a protrusion 54 on the upper surface 53*a*. The lock piece 53 is elastically deformable such that the upper surface 53*a* is vertically moved. Also, holes 55 are formed directly below the lock pieces 53. Each hole 55 is open to the front and has a size that allows several fingers to enter the hole 55. Further, the front cover 51 includes plate piece attachments 57 at two positions of a lower portion of the front cover 51. Plate pieces 56 protruding downward (FIG. 13) are attached to the plate piece attachments 57.

When the waste-toner recovery box 50 is attached to the printer 1 (in particular, to the base piece 71*b* formed at the inner wall 71), the plate pieces 56 are inserted into grooves (not shown) formed at the printer 1. The waste-toner recovery box 50 is raised while the inserted portions serve as support points. Then, the lock pieces 53 are fitted into fixing holes (not shown) formed at the printer 1 while the lock pieces 53 are elastically deformed. When the waste-toner recovery box 50 is detached from the printer 1, thumbs are hooked at the free ends of the lock pieces 53, and the other fingers are inserted into the holes 55. The lock pieces 53 are tilted forward while the thumbs push down the lock pieces 53, so that the protrusions 54 are released from the fixing holes. Then, the waste-toner recovery box 50 is lifted obliquely upward.

The waste-toner recovery box 50 is detached from the printer 1, for example, when the waste-toner recovery box 50 is full and has to be replaced, when the intermediate transfer belt unit has to be replaced, or when the image forming engines 10Y, 10M, 10C, and 10K located at the deeper side with respect to the waste-toner recovery box 50 have to be replaced.

Figure 12:
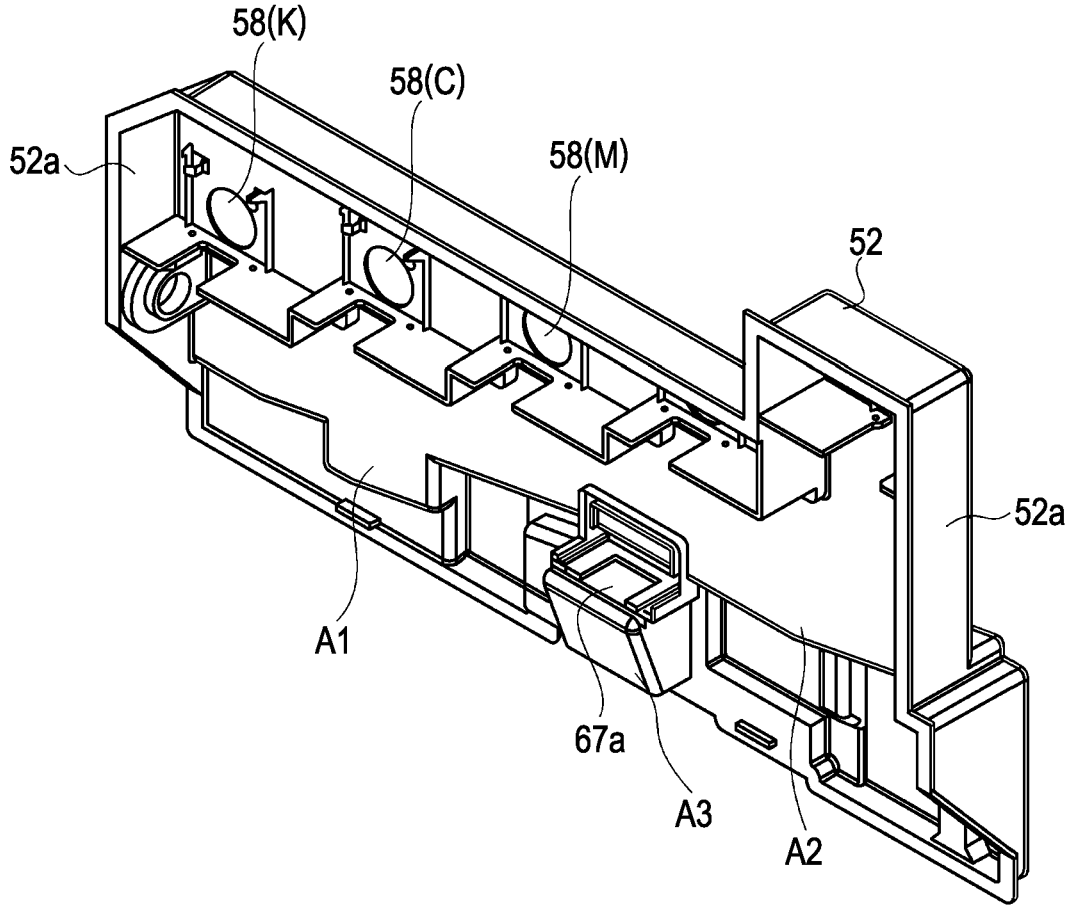
FIG. 12 is a perspective view showing the inside of a rear cover that is a component of the waste-toner recovery box according to the exemplary embodiment of the invention.

Referring to FIGS. 10 and 12, the rear cover 52 has five recovery ports 58 at an upper portion of the rear cover 52. The recovery ports 58 are for the waste toners that are exhausted from the drum cleaners 14 of the image forming engines 10Y, 10M, 10C, and 10K. When the waste-toner recovery box 50 is attached to the printer 1, coupling pipes 73 that protrude from the drum cleaners 14 of the image forming engines 10Y, 10M, 10C, and 10K to the front are inserted into the recovery ports 58. The waste toners exhausted from the drum cleaners 14 of the trickle system are dropped into the waste-toner recovery box 50. The five recovery ports 58 correspond to the drum cleaner 14 of black, the drum cleaner 14 of cyan, the drum cleaner 14 of magenta, the drum cleaner 14 of yellow, and the belt cleaner 23 in order from the right in FIG. 10. The five recovery ports 58 are obliquely laid out corresponding to the positions of the image forming engines 10Y, 10M, 10C, and 10K and the belt cleaner 23.

As described above, the waste-toner recovery box 50 is provided on one side of the image forming engines 10Y, 10M, 10C, and 10K and the belt cleaner 23, so as to cover these components. Thus, the waste toners exhausted from the image forming engines 10Y, 10M, 10C, and 10K and the belt cleaner 23 are directly dropped into the waste-toner recovery box 50.

Figure 13:
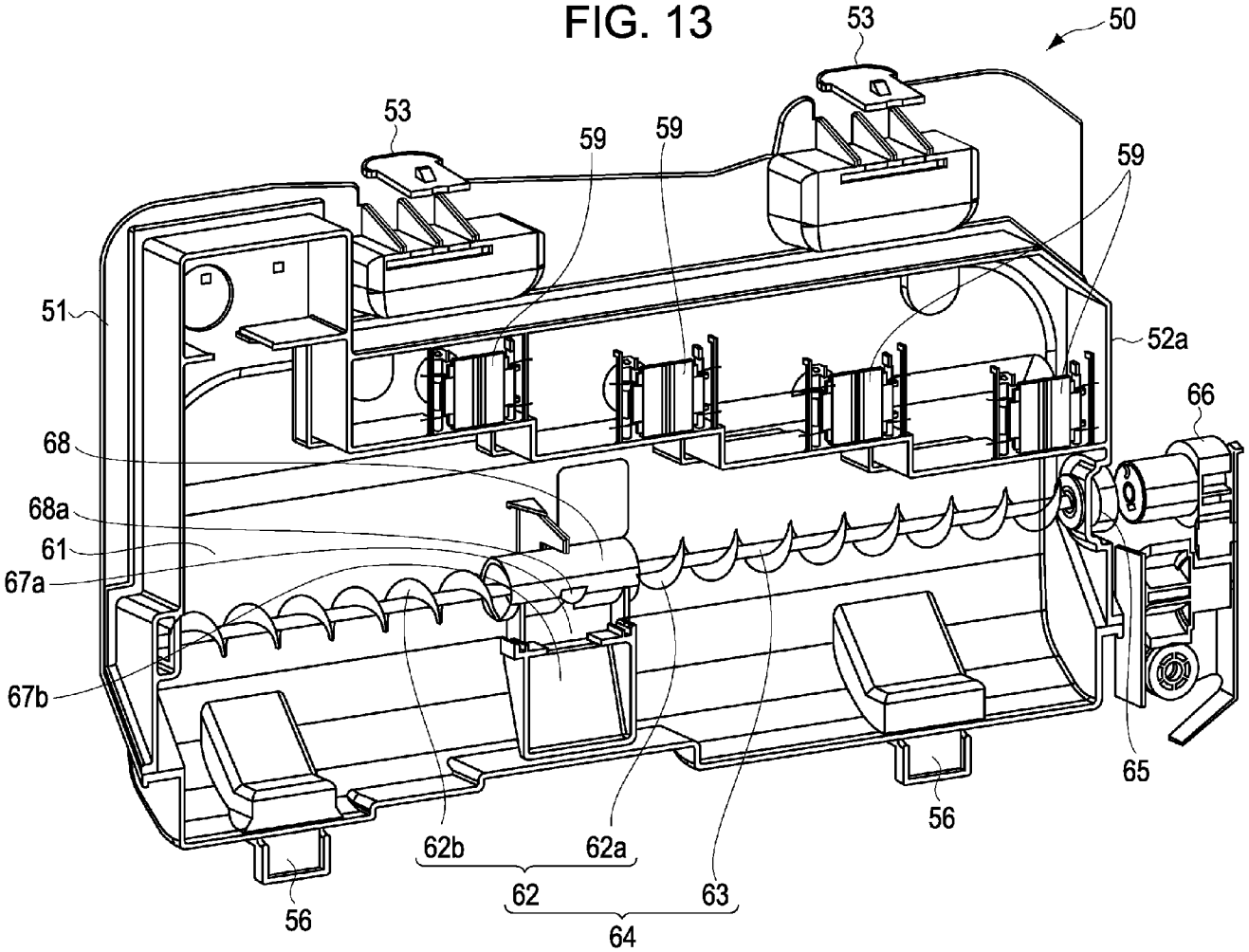
FIG. 13 is a perspective view showing an inner structure of the waste-toner recovery box according to the exemplary embodiment of the invention when viewed from the rear.
Figure 14:
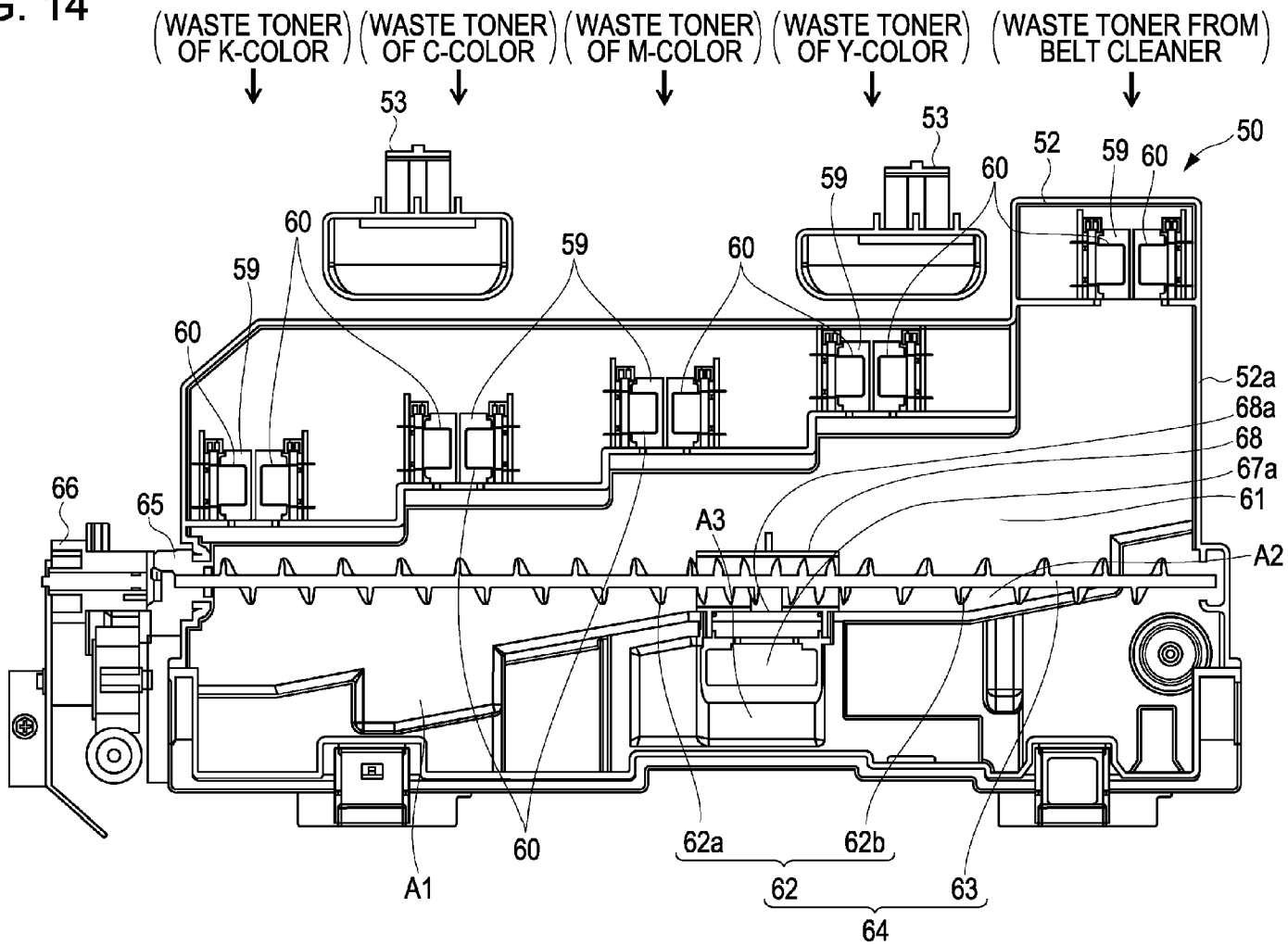
FIG. 14 is a perspective view showing an inner structure of the waste-toner recovery box according to the exemplary embodiment of the invention when viewed from the front.

Referring to FIG. 13, shutters 59 are provided at the recovery ports 58. Each shutter 59 has a double-panel structure that opens from the center to the left and right. The shutter 59 is openably and closably attached to the inside of the rear cover 52. The shutter 59 has torsion springs 60 that presses the shutter 59 to the wall surface of the rear cover 52 and closes the recovery port 58 (FIG. 14). The shutter 59 normally closes the recovery port 58 by the spring force of the torsion springs 60. When the coupling pipe 73 is inserted into the recovery port 58, the coupling pipe 73 pushes the shutter 59 inward against the spring force, and hence the recovery port 58 is open.

Referring to FIGS. 13 and 14, the waste-toner recovery box 50 formed of the front cover 51 and the rear cover 52 has the reservoir chamber 61 (an example of a first room) in the waste-toner recovery box 50. The reservoir chamber 61 stores the recovered waste toners. The reservoir chamber 61 is located below the recovery ports 58. The waste toners are dropped from the coupling pipes 73 inserted into the recovery ports 58. When the reservoir chamber 61 is filled with the waste toners (when the quantity of the waste toners reaches a storage limit), the waste-toner recovery box 50 has to be replaced.

A conveying unit 64 is provided in the reservoir chamber 61 and extends in the longitudinal direction. The conveying unit 64 extends between side walls of the reservoir chamber 61 (that is, the conveying unit 64 extends between left and right side walls 52*a* of the rear cover 52). The waste toners dropped into the reservoir chamber 61 are accumulated like hills at positions directly below the recovery ports 58. When the tops of the hills exceed the storage limit of the waste-toner recovery box 50, the portion exceeding the storage limit is collapsed and conveyed.

One side of the conveying unit 64 is supported by a bearing 65 provided at the side wall 52*a*, and a distal end of the one side of the conveying unit 64 protrudes outside the side wall 52*a*. The distal end is a torque supply end through which a driving force (a torque) is supplied to the conveying unit 64. A transmission unit 66 is attached to the distal end. The transmission unit 66 includes a transmission gear train (not shown) that transmits a driving force from a drive source (not shown) provided in the printer 1 to the conveying unit 64. When the waste-toner recovery box 50 is attached to the printer 1, the transmission unit 66 is mechanically coupled with the drive source in the printer 1. Thus, the conveying unit 64 is driven (rotated) by the drive source.

The conveying unit 64 is fabricated by, for example, injection molding with synthetic resin. The conveying unit 64 has a rotating shaft 63 and a spiral blade 62 (an example of a blade) that conveys the waste toner to an area around the rotating shaft 63. The spiral blade 62 includes a first blade 62*a* and a second blade 62*b* whose spiral directions differ from one another. The spiral directions of the blades 62*a* and 62*b* correspond to directions in which the waste toners are conveyed from the ends of the rotating shaft 63 to the center.

The blades 62*a* and 62*b* are lacking in an area between a position directly below the recovery port 58 for the waste toner of yellow Y and a position directly below the recovery port 58 for the waste toner of magenta M. The positions correspond to the ends of conveyance. When the conveying unit 64 is rotated, the waste toners accumulated like hills in the reservoir chamber 61 are collapsed and conveyed toward those positions.

Figure 15:
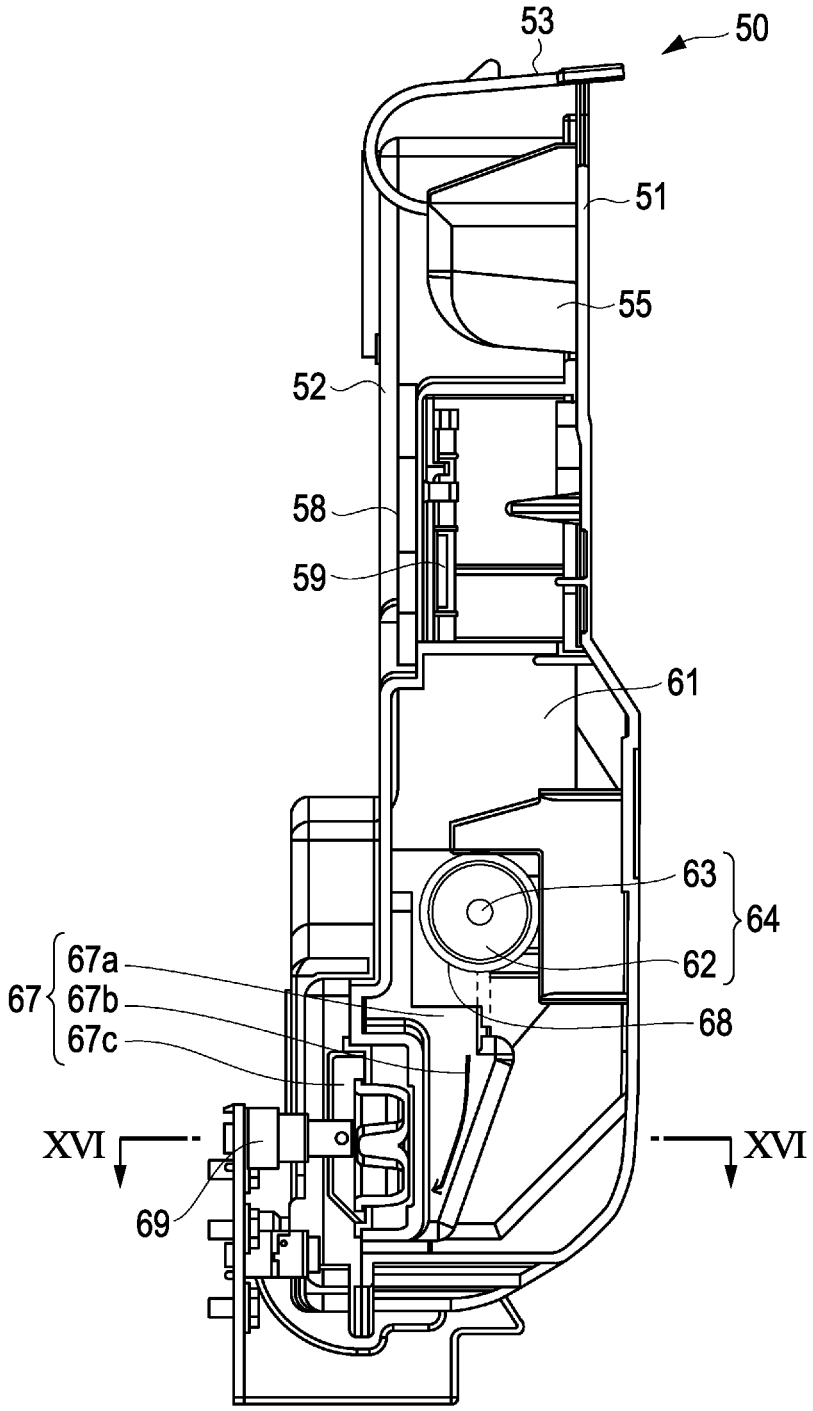
FIG. 15 is a cross-sectional view taken along line XV-XV in FIG. 9.

Referring to FIG. 15, the detection chamber 67 (an example of a second room) is spatially continuously connected with the reservoir chamber 61. The waste toner exceeding the storage limit of the reservoir chamber 61 enters the detection chamber 67. If the waste toner is accumulated to a predetermined level in the reservoir chamber 61 (that is, the storage limit of the reservoir chamber 61), the quantity of the waste toner exceeding the level (that is, exceeding the storage limit) enters the detection chamber 67.

Figure 16:
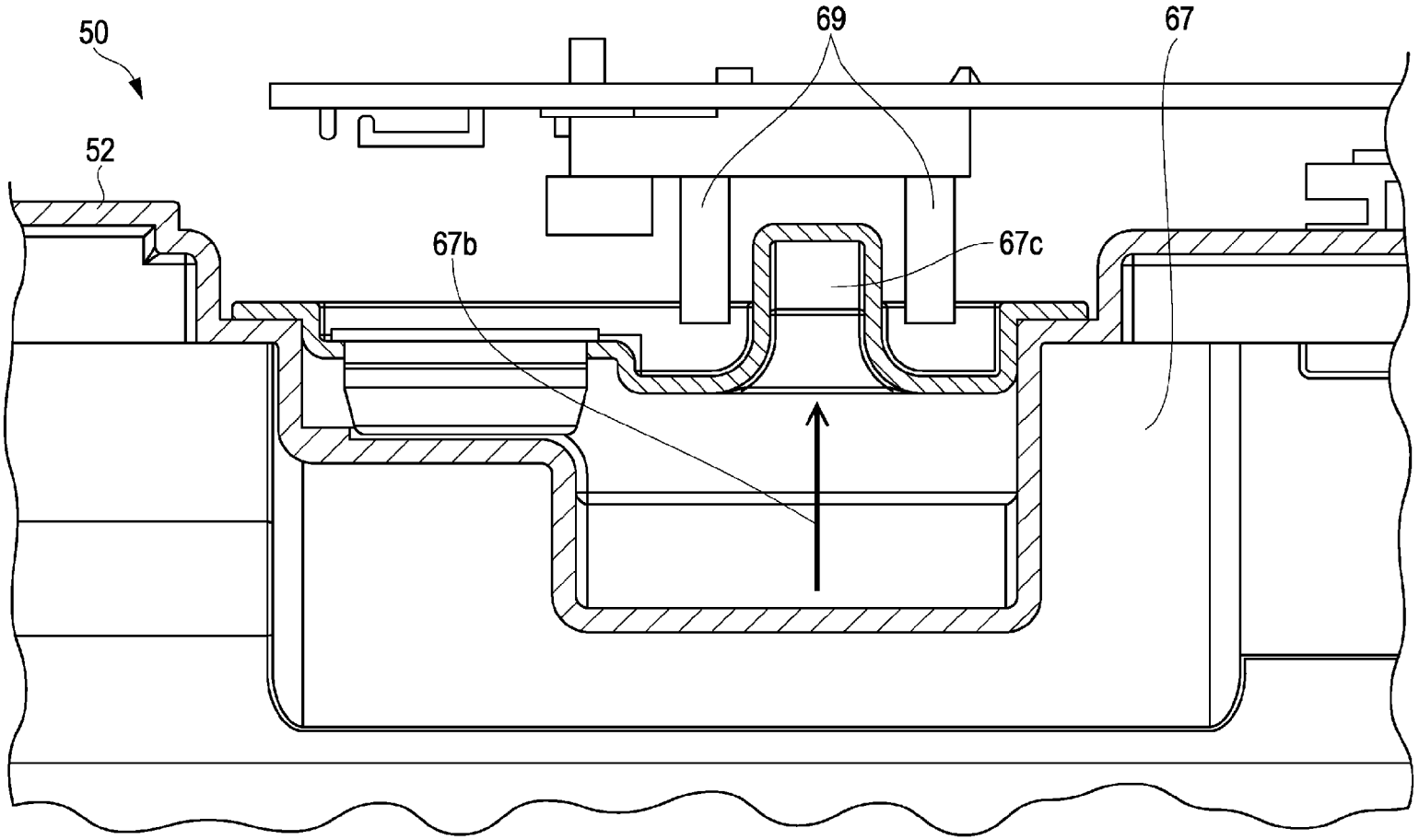
FIG. 16 is a cross-sectional view showing a specific part taken along line XVI-XVI in FIG. 15.

Referring to FIG. 16, the detection chamber 67 has a sensing chamber 67*c* that is attached to the rear cover 52 and formed of a transparent member protruding to the outside. When the waste-toner recovery box 50 is attached to the printer 1, the sensing chamber 67*c* is inserted into an area between a light-emitting portion and a light-receiving portion of a light transmission sensor 69 (an example of a sensor) that is provided at the printer 1.

Referring to FIG. 15, a waste-toner path 67*b* extends from an entrance 67*a* of the detection chamber 67. The waste-toner path 67*b* has an inclined surface that is located below the conveying unit 64. The sensing chamber 67*c* is located ahead of the inclined surface. Namely, the sensing chamber 67*c* is not arranged directly below the entrance 67*a*. Thus, the waste toner dropped from the reservoir chamber 61 is gradually accumulated in the sensing chamber 67*c* because of the inclined surface of the waste-toner path 67*b*. When the area between the light-emitting portion and the light-receiving portion of the light transmission sensor 69 is blocked by the waste toner in the sensing chamber 67*c*, the signal of the light transmission sensor 69 is changed. Accordingly, it is recognized whether the waste toner reaches the predetermined level of the reservoir chamber 61.

Referring to FIG. 14, the entrance 67*a* of the detection chamber 67 is formed in an area not occupied by the first blade 62*a* or the second blade 62*b* of the conveying unit 64, i.e., at a position facing the ends of conveyance. Thus, the waste toner exceeding the storage limit of the reservoir chamber 61 is conveyed to the entrance 67*a* of the detection chamber 67 by the conveying unit 64.

Figure 17:
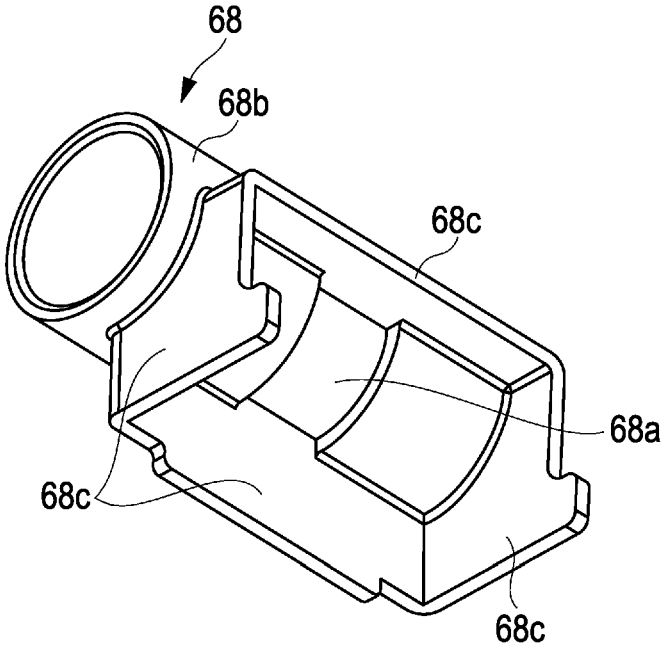
FIG. 17 is a perspective view showing a pipe that is a component of the waste-toner recovery box according to the exemplary embodiment of the invention when viewed from the lower front.
Figure 18:
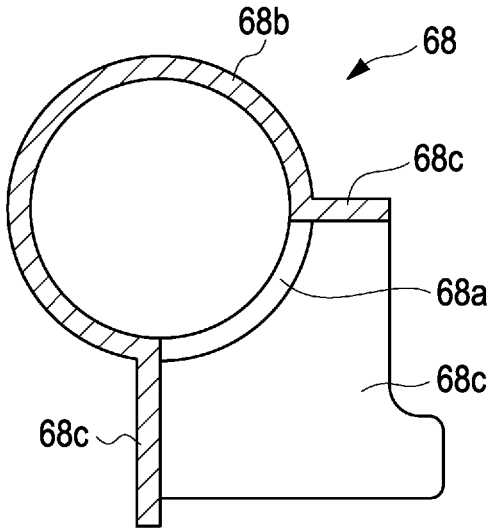
FIG. 18 is a cross-sectional view taken along the diameter of the pipe shown in FIG. 17.

Referring to FIGS. 17 and 18, a pipe 68 is arranged at the entrance 67*a* of the detection chamber 67. The conveying unit 64 penetrates through the pipe 68. The pipe 68 has a peripheral wall 68*b* serving as a pipe body and an opening 68*a* formed in the peripheral wall 68*b*. The opening 68*a* faces the entrance 67*a* of the detection chamber 67. The ends of conveyance for the waste toner corresponding to the area not occupied by the blade 62*a* or 62*b* are located at the opening 68*a* of the pipe 68 (see FIG. 19). The waste toner does not enter the detection chamber 67 unless the waste toner passes through the pipe 68. The pipe 68 has a partition wall 68*c* that extends downward from the peripheral wall 68*b* and that separates the entrance 67*a* of the detection chamber 67 from the reservoir chamber 61, to prevent the waste toner from entering the detection chamber 67 through a path other than the opening 68*a* of the pipe 68.

Figure 19:
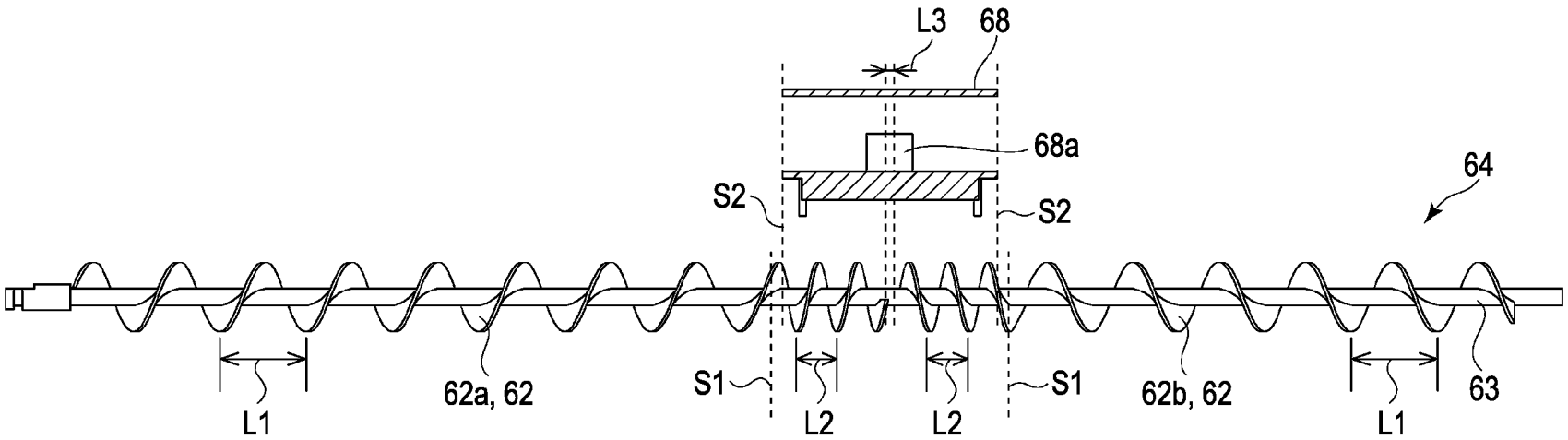
FIG. 19 is an explanatory view showing a relationship between a conveying unit and the pipe in the waste-toner recovery box according to the exemplary embodiment of the invention.

Referring to FIG. 19, a distance L3 is provided between the position at which the first blade 62*a* is ended and the position at which the second blade 62*b* is ended. Thus, the conveyed waste toner is easily dropped.

With this configuration, when the waste toner locally exceeds the storage limit of the reservoir chamber 61, the excessive waste toner is collapsed and conveyed to the center of the reservoir chamber 61 by the conveying unit 64. Since the waste toner is collapsed to the portion not occupied by the spiral blade 62 of the conveying unit 64, a space is finally left only below the portion not occupied by the spiral blade 62 in the reservoir chamber 61. When the space is eliminated because the waste toner is conveyed by the conveying unit 64, the reservoir chamber 61 is filled with the waste toner. That is, the waste toner reaches the storage limit.

Then, the waste toner exceeding the storage limit is conveyed by the conveying unit 64 and enters into the pipe 68. The waste toner in the pipe 68 enters the detection chamber 67 through the opening 68*a* of the pipe 68. The light transmission sensor 69 detects the waste toner in the sensing chamber 67*c*. Accordingly, the output signal of the light transmission sensor 69 is changed, and it is recognized that the reservoir chamber 61 is full.

If the image forming engines 10Y, 10M, 10C, and 10K are replaced, the waste-toner recovery box 50 located in front of the image forming engines 10Y, 10M, 10C, and 10K has to be detached. At this time, if the detached waste-toner recovery box 50 is left in a state in which the rotating shaft 63 of the conveying unit 64 is not horizontal (i.e., in a state in which the rotating shaft 63 is tilted or vertically stands), the waste toner in the reservoir chamber 61 may be collapsed and part of the waste toner may enter the detection chamber 67 through the entrance 67*a* unless the pipe 68 is provided. Then, if the waste toner enters the detection chamber 67 by a quantity of the waste toner that is detected by the light transmission sensor 69, when the waste-toner recovery box 50 is attached to the printer 1, the output signal of the light transmission sensor 69 may be changed and it may be erroneously recognized that the reservoir chamber 61 is full although the reservoir chamber 61 is not filled with the waste toner.

Also, dust resulted from the waste toner floats in the reservoir chamber 61. The dust is generated mostly when the conveying unit 64 conveys the waste toner, in particular, when the conveying unit 64 collapses the waste toners accumulated like hills when the waste toners locally exceed the storage limit. Hence, if the pipe 68 is not provided, since the generated dust is lighter than the waste toner, part of the dust may not be conveyed by the conveying unit 64 and may float and enter the detection chamber 67 through the entrance 67*a*. If such a state repeatedly appears, and if the dust is accumulated in the detection chamber 67 by a quantity of the dust that is detected by the light transmission sensor 69, the output signal of the light transmission sensor 69 may be changed, and it may be erroneously detected that the reservoir chamber 61 is full although the reservoir chamber 61 is not filled with the waste toner.

In contrast, in this exemplary embodiment, the conveying unit 64 having the spiral blade 62 penetrates through the pipe 68, the ends of conveyance face the opening 68*a* of the pipe 68, and hence the waste toner in the reservoir chamber 61 does not enter the detection chamber 67 unless the waste toner passes through the pipe 68. The waste toner collapsed when the waste-toner recovery box 50 is detached, and the dust generated when the conveying unit 64 conveys the waste toner are blocked by the pipe 68 and the spiral blade 62 and prevented from entering the detection chamber 67. Accordingly, the erroneous detection that the waste-toner recovery box 50 is full is prevented, and detection accuracy is increased.

Referring to FIG. 19, a pitch of (a distance between) the blades 62*a* and 62*b* includes two types of pitches of a first distance L1 and a second distance L2 that is smaller than the first distance L1. In this exemplary embodiment, the first distance L1 is, for example, 20 mm. The first distance L1 is arranged outside the pipe 68. The second distance L2 is, for example, 9 mm. The second distance L2 is arranged inside the pipe 68. A boundary position S1 between the first distance L1 and the second distance L2 is located farther from the pipe 68 than an end position S2 of the pipe 68.

Since the pitch of the blade 62 within the pipe 68 is the second distance L2 that is smaller than the first distance L1, the gaps of the spiral blade 62 decreases in areas where the ends of the pipe 68 overlap the spiral blade 62. Hence, the storage space for the waste toner decreases. The waste toner collapsed and dropped when the waste-toner recovery box 50 is detached hardly enters the pipe 68. Thus, the waste toner hardly reaches the opening 68*a* of the pipe 68. The erroneous detection that the waste-toner recovery box 50 is full is further reliably prevented.

For laying out the two rotating shafts 70*a* that are obliquely provided at the positioning plate 70, referring to FIGS. 12 and 14, in order to prevent the waste-toner recovery box 50 from interfering with a lower one of the rotating shafts 70*a* (a rotating shaft 70*a*-1), the waste-toner recovery box 50 has a first protrusion A1 formed such that a part of a lower left portion of the rear cover 52 when viewed from the inside protrudes inward. The lower left portion corresponds to a first region including a region in which the waste toner of K-color removed from the photoconductor drum 11 by the drum cleaner 14 of K-color is dropped and a region in which the waste toner of C-color removed from the photoconductor drum 11 by the drum cleaner 14 of C-color is dropped. The first protrusion A1 partly occupies the capacity of the reservoir chamber 61 that is the storage space for the waste toner.

Also, referring to FIGS. 12 and 14, in order to prevent the waste-toner recovery box 50 from interfering with an upper one of the rotating shafts 70*a* (a rotating shaft 70*a*-2), the waste-toner recovery box 50 has a second protrusion A2 formed such that a part of a lower right portion of the rear cover 52 protrudes inward. The lower right portion corresponds to a second region including a region in which the waste toner removed from the intermediate transfer belt 20 by the belt cleaner 23 is dropped and a region in which the waste toner of Y-color removed from the photoconductor drum 11 by the drum cleaner 14 of Y-color is dropped. A protruding position of the second protrusion A2 is higher than a protruding position of the first protrusion A1 because the rotating shaft 70*a*-2 is located above the rotating shaft 70*a*-1 (that is, because the rotating shaft 70*a*-2 is at a substantially equivalent height to the height of the position of the conveying unit 64). Accordingly, the occupying volume of the second region with respect to the actual capacity of the reservoir chamber 61 for the waste toner is smaller than the occupying volume of the first region.

Therefore, the capacity of the first region for the storage of the waste toner of K-color (based on the design of the apparatus, the quantity of the waste toner of K-color is large next to the waste toner from the belt cleaner 23) and the waste toner of C-color is smaller than the capacity of the second region for the storage of the waste toner of the belt cleaner 23 and the waste toner of Y-color. The detection chamber 67 is formed in a third protrusion A3 protruding into the reservoir chamber 61. If the third protrusion A3 is formed at a position close to the first region, the capacity of the first region further decreases.

If a recording medium such as a sheet is made of a material with a low toner transfer efficiency, the quantity of the waste toner from the belt cleaner 23 further increases. Hence, the capacity of the second region has to be sufficiently provided. However, if the capacity of the second region is provided by shifting the position of the entrance 67*a* of the detection chamber 67 that spatially connects the reservoir chamber 61 with the detection chamber 67 to the first region, and arranging the sensor 69 for detecting the full state of the waste-toner recovery box 50 is shifted to a position corresponding to the first region of the waste-toner recovery box 50 in the printer 1, the capacity of the first region further decreases.

If the thickness of the waste-toner recovery box 50 is increased, the capacity that is decreased for avoiding the interference between the waste-toner recovery box 50 with the rotating shafts 70*a* or the sensor 69 may be compensated. In addition, if the thickness of the waste-toner recovery box 50 is increased, although the detection chamber 67 into which the waste toner flows is arranged below the recovery port 58, the waste toner drop position may be shifted from the detection chamber 67 in the thickness direction. Thus, the degree of freedom for the arrangement of the sensor 69 is increased.

However, since the layout space for the waste-toner recovery box 50 is limited in the printer 1, it is difficult to increase the thickness of the waste-toner recovery box 50. Accordingly, the sensor 69 has to be laid out at the position at which the sensor 69 does not overlap the detection chamber 67 in the vertical direction, and at which the sensor 69 does not overlap the rotating shafts 70*a* in the thickness direction of the waste-toner recovery box 50.

Further, as described above, since the positioning plate 70 is tilted forward around the two obliquely arranged rotating shafts 70*a*, if the sensor 69 is arranged near the center of the two rotating shafts 70*a*, or near the lower rotating shaft 70*a*-1 with respect to the center (that is, near the first region), the tilted positioning plate 70 may interfere with the sensor 69 (see FIG. 6).

In this exemplary embodiment, particularly referring to FIG. 14, the detection chamber 67, to which the waste toner in the reservoir chamber 61 is introduced, is formed below an area between the recovery port 58 (herein, the Y-color recovery port 58, i.e., the recovery port 58 for the waste toner of Y-color removed from the photoconductor drum 11 by the drum cleaner 14 of Y-color) that is located next to the top recovery port 58 (i.e., the recovery port 58 for the waste toner removed from the intermediate transfer belt 20 by the belt cleaner 23) and the recovery port 58 (herein, the M-color recovery port 58, i.e., the recovery port 58 for the waste toner of M-color removed from the photoconductor drum 11 by the drum cleaner 14 of M-color) that is located next to the Y-color recovery port 58. The detection chamber 67 has the entrance 67*a* that spatially connects the detection chamber 67 with the reservoir chamber 61. The waste toner in the reservoir chamber 61 flows into the detection chamber 67 through the entrance 67*a*. Thus, the third protrusion A3 for the detection chamber 67 is arranged below an area between the Y-color recovery port 58 and the M-color recovery port 58. Accordingly, the sensor 69 arranged directly below the entrance 67*a* is also arranged below the area between the Y-color recovery port 58 and the M-color recovery port 58.

Accordingly, the above problems may be addressed, and the storage space in the reservoir chamber 61 may be provided for the waste toner removed from the intermediate transfer belt 20 by the belt cleaner 23. In addition, although the protrusion (the first protrusion A1) is provided to avoid the interference with the lower rotating shaft 70*a*-1 of the positioning plate 70, the occupation by the third protrusion A3 that forms the detection chamber 67 is eliminated. Thus, the storage space is provided in the reservoir chamber 61 for the waste toner of K-color removed from the photoconductor drum 11 by the drum cleaner 14 of K-color. At this time, the capacity of the second region is not sacrificed.

During image formation, the toners of Y-color, M-color, C-color, and K-color are transferred on the intermediate transfer belt 20 from the photoconductor drums 11 in that order. Since part of the toners transferred on the intermediate transfer belt 20 is transferred again on the photoconductor drums 11, the quantity of the toners to be transferred again on the photoconductor drums 11 becomes larger in order of the photoconductor drums 11 of Y-color, M-color, C-color, and K-color. Hence, the exhausted quantity of the waste toners removed from the photoconductor drums 11 by the drum cleaners 14 of the respective colors becomes larger in order of the photoconductor drums 11 of Y-color, M-color, C-color, and K-color.

Regarding the reason described above, the entrance 67*a* of the detection chamber 67 is provided at a position shifted from a middle position between the recovery port 58 for the waste toner from the drum cleaner 14 of K-color and the recovery port 58 for the waste toner from the belt cleaner 23 to the recovery port 58 for the waste toner from the belt cleaner 23. The sensor 69 is arranged directly below the entrance 67*a*. That is, as described above, the sensor 69 is arranged below the area between the Y-color recovery port 58 and the M-color recovery port 58.

The toners conveyed from the drum cleaners 14 of K-color and C-color, dropped through the recovery ports 58, and accumulated like hills are collapsed by the conveying unit 64, and then flows into the detection chamber 67 through the entrance 67*a*. Accordingly, the timing at which the waste toner enters the sensing chamber 67*c* formed in the detection chamber 67 is delayed by the quantity of the waste toner that is collapsed and equalized. This may extend the period detected such that the waste toner is not full, and may extend the replacement cycle for the waste-toner recovery box 50.

In this exemplary embodiment, arranged at the top is the recovery port 58 for the waste toner removed from the intermediate transfer belt 20 by the belt cleaner 23, arranged next are the recovery ports 58 for the waste toners removed from the photoconductor drums 11 by the drum cleaners 14 of Y-color, M-color, and C-color, and arranged at the bottom is the recovery port 58 for the waste toner removed from the photoconductor drum 11 by the drum cleaner 14 of K-color. However, it is not limited thereto. The recovery ports 58 of any colors may be arranged except the top and bottom recovery ports 58.

In this exemplary embodiment, the spiral blade 62 of the conveying unit 64 includes the first blade 62*a* and the second blade 62*b* that convey the waste toners from the ends of the rotating shaft 63 to the center. However, a conveying unit may include a blade having a single spiral direction to convey a waste toner in one direction of the rotating shaft 63.

In the above description, the color image forming apparatus with the four colors including Y-color, M-color, C-color, and K-color are used. However, the number of colors and the types of colors are not limited thereto. Colors necessary for formation of a desirable color image may be adequately applied.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer recovery container, comprising:

a first room that stores a recovered developer;

a plurality of recovery ports that face the first room and are linearly arranged through which a developer removed from an intermediate transfer unit by a cleaning unit for the intermediate transfer unit and a developer removed from an image bearing member by a cleaning unit for the image bearing member are dropped into the first room;

a second room wherein the developer flows from the first room to the second room;

a conveying unit that conveys the developer in the first room to the second room by a quantity of the developer exceeding a storage limit of the first room including a pipe, such that the conveying unit penetrates through the pipe in a longitudinal direction thereof, and wherein the pipe has both ends in the longitudinal direction, a peripheral wall and an opening in the peripheral wall, wherein the second room is positioned below the first room, wherein the pipe is disposed proximate to the second room and the opening in the peripheral wall of the pipe forms an entrance to the second room such that developer conveyed from the first room to the second room travels through the pipe, and wherein the developer in the first room enters the pipe through the both ends in the longitudinal direction; and a sensor that detects the developer in the second room.

2. An image forming apparatus, comprising the developer recovery container according to claim 1 attached to the image forming apparatus.

3. The developer recovery container according to claim 1, wherein the spiral blade has two types of pitches of a first distance L1 and a second distance L2, wherein the pitches are each a distance between two adjacent turns of the spiral blade.

4. The developer recovery container according to claim 3, wherein the second distance L2 is smaller than the first distance L1.

5. The developer recovery container according to claim 4, wherein the second distance L2 is arranged inside the pipe.

6. A developer recovery container, comprising:

a first room that stores a recovered developer;

a plurality of recovery ports that face the first room and are linearly arranged through which a developer removed from an intermediate transfer unit by a cleaning unit for the intermediate transfer unit, and a developer removed from an image bearing member by a cleaning unit for the image bearing member are dropped into the first room;

a second room wherein the developer flows from the first room to the second room;

a conveying unit that conveys the developer in the first room to the second room by a quantity of the developer exceeding a storage limit of the first room including a pipe such that the conveying unit penetrates through the pipe, and wherein the pipe has a peripheral wall and an opening in the peripheral wall, wherein the pipe is disposed proximate to the second room, and the opening in the peripheral wall of the pipe forms an entrance to the second room such that developer conveyed from the first room to the second room travels through the pipe, and the conveying unit has an outside portion that is outside the pipe and an inside portion that is inside the pipe, and the inside portion has a first spiral blade and a second spiral blade whose spiral directions differ from one another; and a sensor that detects the developer in the second room.

7. The developer recovery container according to claim 6, wherein the first spiral blade and the second spiral blade convey the developer toward a center of the pipe where the opening is formed.

8. A developer recovery container, comprising:

a first room that stores a recovered developer;

a plurality of recovery ports that face the first room and are linearly arranged through which a developer removed from an intermediate transfer unit by a cleaning unit for the intermediate transfer unit, and a developer removed from an image bearing member by a cleaning unit for the image bearing member are dropped into the first room;

a second room wherein the developer flows from the first room to the second room;

a conveying unit that conveys the developer in the first room to the second room by a quantity of the developer exceeding a storage limit of the first room including a pipe such that the conveying unit penetrates through the pipe, and wherein the pipe has a peripheral wall and an opening in the peripheral wall, wherein the pipe is disposed proximate to the second room, and the opening in the peripheral wall of the pipe forms an entrance to the second room such that developer conveyed from the first room to the second room travels through the pipe, and the conveying unit has an outside portion that is outside the pipe and an inside portion that is inside the pipe, the outside portion has a spiral blade whose pitch is L1, and the inside portion has a spiral blade whose pitch is L2, such that L2 is smaller than L1, wherein the pitch L1 is a distance between two adjacent turns of the spiral blade of the outside portion, and the pitch L2 is a distance between two adjacent turns of the spiral blade of the inside portion; and a sensor that detects the developer in the second room.

* * * * *